United States Patent [19]

Finney

[11] Patent Number: 5,060,950

[45] **Date of Patent: * Oct. 29, 1991**

[54] CORNER-BACK GOLF CLUBHEAD

[76] Inventor: Clifton D. Finney, 1057 Oak Hills Pkwy., Baton Rouge, La. 70810

[ * ] Notice: The portion of the term of this patent subsequent to Jan. 15, 2008 has been disclaimed.

[21] Appl. No.: 528,868

[22] Filed: May 25, 1990

Related U.S. Application Data

[63] Continuation-in-part of Ser. No. 413,632, Sep. 28, 1989, Pat. No. 4,984,799, which is a continuation-in-part of Ser. No. 359,109, May 31, 1989, Pat. No. 4,995,612.

[51] Int. Cl.[5] ..... A63B 53/04

[52] U.S. Cl. ..... 273/167 F; 273/169; 273/173

[58] Field of Search ..... 273/167–175, 273/77 A, 77 R, 163 R, 164; D21/214–220

[56] References Cited

U.S. PATENT DOCUMENTS

| | | | |
|---|---|---|---|
| D. 248,783 | 8/1978 | Long | D21/219 |
| 1,133,129 | 3/1915 | Govan | 273/169 |
| 1,671,936 | 5/1928 | Sime | 273/169 |
| 2,007,377 | 7/1935 | Link | 273/77 |
| 2,254,528 | 9/1941 | Hoare | 273/77 |
| 2,846,228 | 8/1958 | Reach | 273/169 |
| 3,655,188 | 4/1972 | Solheim | 273/77 A |
| 3,847,399 | 11/1974 | Raymont | 273/167 F |
| 3,941,390 | 3/1976 | Hussey | 273/169 |
| 4,607,846 | 8/1986 | Perkins | 273/171 |
| 4,621,813 | 11/1986 | Solheim | 273/77 A |
| 4,650,191 | 3/1987 | Mills | 273/164 |
| 4,762,324 | 8/1988 | Anderson | 273/164 |
| 4,828,265 | 5/1989 | Antonious | 273/167 E |

FOREIGN PATENT DOCUMENTS 1232651 5/1971 United Kingdom .

OTHER PUBLICATIONS

Barber, *Golf Digest*, Jun., 1976, p. 30.
*Golf World*, Jul., 1976, p. 31.
Slazenger, *Golf World*, Jan., 1988, p. 37.

*Primary Examiner*—Edward M. Coven
*Assistant Examiner*—Sebastiano Passaniti

[57] ABSTRACT

A golf clubhead with enhanced moments of inertia along both its twist and loft axes has a toe weight means of a first predetermined density comprising first and second substantial percentages as upper and lower concentrations of mass positioned respectively in predetermined fixed locations adjacent the top and bottom corners of the toe between the striking surface and the back. A medium of a second predetermined density less dense than the first predetermined density of the toe weight means may substantially separate the upper concentration from the lower concentration, the upper concentration and may generally separate from the central boundary of the toe section. Too, the width of the toe weight means between the striking surface and the back of the clubhead may assume a first minimal value in the region toward the top and the central boundary of the toe section, a first maximal value toward the top and the toe which is greater than the first minimal value, a second minimal value between the upper and lower concentrations toward the toe which is less than the first maximal value, and a second maximal value toward the sole and the toe which is greater than the second minimal value.

15 Claims, 5 Drawing Sheets

CORNER-BACK GOLF CLUBHEAD

CROSS-REFERENCE TO RELATED APPLICATIONS

The present work is a continuation-in-part application of the parent application entitled, "A Golf Clubhead with a Corner-Back System of Weight Distribution," filed Sept. 28, 1989 under Ser. No. 07/413,632, now U.S. Pat. No. 4,984,799 which is a continuation-in-part application of the grandparent application entitled, "A Golf Clubhead in a Corner Back Configuration," filed May 31, 1989 under Ser. No. 07/359,109, now U.S. Pat. No. 4,995,612.

BACKGROUND—FIELD OF INVENTION

This invention relates to golf clubheads with enhanced moments of inertia along the vertical twist and horizontal loft axes to reduce twisting and loft changes, respectively, when a golf ball is struck.

BACKGROUND—DESCRIPTION OF PRIOR ART

At least three moments of inertia and a clubhead's center of mass come into play in the act of striking a golf ball. The first and largest moment of inertia is that about a swing axis which runs approximately through the midpoint of a golfer's shoulders at the base of the neck, and which is perpendicular to plane of the golf swing. This moment is related to the primary kinetic energy of a golf swing.

The rotational analog of kinetic energy is $1/2(Iw^2)$, where I is the moment of inertia of a rotating body and w is its angular velocity. In turn, the moment I may taken as the sum of the $mr^2$ where r is the length of a moment arm from a reference axis to a mass-point of the body. In a first approximation because the moment arm is relatively long, the moment of inertia about a swing-axis may be taken as the mass of a clubhead times the square of the distance from the swing axis to the center of mass of clubhead. Thus at constant angular velocity, w, lowering or raising the center of mass of a clubhead marginally increases or decreases, respectively, its kinetic energy at impact.

The second and third moments of inertia, about the vertical twist axis and horizontal loft axis of a clubhead, respectively, are much smaller in magnitude than that about the swing axis. Expressions for the calculation of these moments in the form of EQNS. 10*a* and 10*b* together with the algorithm Inertia for their computation were presented in the grandparent. Despite their smaller magnitude, these moments assume significance in the common situation where a ball is miss-struck off the projection of the clubhead's center of mass onto the ball striking face.

For example, if the ball is struck toward the toe or heel away from the projection of the center of mass onto the striking face, it may tend to fly left or right of target as the clubhead twists in the golfer's hand. Too, if the ball is struck toward the top or bottom away from the projection of the center of mass onto the striking face, it may tend to fly long or short as the clubhead's effective loft changes.

Heretofore the best solutions offered for reducing twist and loft changes at impact have relied upon designing a clubhead with slightly enhanced moments of inertia across the vertical twist and horizontal loft axes of a clubhead. More specifically, these solutions are usually in the form of modern cavity-back and hollow-back clubheads. Such clubheads may be thought of as blend of functional, structural, and inertial components.

Functional components include a ball striking surface to contact a ball; a sole to contact the earth; and an attachment means, usually a hosel, to attach a shaft with a grip for a golfer to hold. Structural components include braces, cavities for weights, and the like to yield a strong unitary clubhead. Inertial components include various weights to optimize the moment of inertia along one or more axes and to control the position of the center of mass on the clubhead.

A determination of exactly what is a functional, structural, or inertial component in a clubhead is made somewhat easier when the density of a weight differs from that of the remainder of the clubhead. For example, lead is too soft and weak to be considered much of a functional or structural component.

However, a determination becomes more difficult when the density of a clubhead is singular. For example, in an ordinary cavity-back iron, say of steel or copper alloy, the peripheral material around the cavity may be regarded to be both a structural brace for the striking face and an inertial weight. Similarly, in an ordinary hollow-back iron or wood, the material on the top and along the heel, toe, and back may be both structural brace and an inertial weight.

In view of the strength of standard clubhead materials such as beryllium-copper and steel and of available, high strength, low density alloys such as those of aluminum and titanium, it seems reasonable to suggest that in general there has been an overemphasis on structural bracing and an underemphasis on inertial weighting of the modern clubhead.

The present work, then, advances the concepts of the corner-back configuration and the corner-back system of weight distribution set forth in the grandparent and parent, respectively. A basic form of the corner-back configuration was illustrated with the near-clubhead of FIG. 13 in the grandparent. In turn, a basic form of the corner-back system of weight distribution was set forth with the near-clubhead of FIG. 13 in the parent.

Briefly, the corner-back configuration may have first and second substantial percentages of the toe weight means as upper and lower concentrations of mass positioned adjacent the upper and lower corners of the toe, respectively, with each concentration extending in the rear region from near the rear surface of the ball striking means toward the back and between the extreme of the toe and the central boundary of the toe section. In this manner, moments of inertia across the vertical twist and horizontal loft axes are made simultaneously optimal while the position of the center of mass is also controlled.

The corner-back system of weight distribution may have a lower density body and higher density toe weight means. First and second substantial percentages of the toe weight means may exist as increased upper and lower concentrations of mass in predetermined fixed locations adjacent the top and bottom corners of the toe, respectively. Thus, a clubhead with a corner-back system of weight distribution may, or may not, have a corner-back configuration.

In more specific terms, the current work moves to define the corner-back clubhead more particularly and distinctly by emphasizing certain key density and dimensional relationships as follows.

OBJECTS AND ADVANTAGES

Accordingly, the several objects and advantages of this invention begin with a golf clubhead comprising a body and a head weight means with at least one head weight serving as inertial weight for the clubhead.

Another object is to have a clubhead with a toe and heel, front and back, and a top and a sole with a ball striking surface toward the front.

Too, an object is to have a binding means to attach the head weight means to the clubhead and a fastening means to affix a shaft between the heel and toe.

Still another object is to have a toe section extending a half-length of the clubhead from the extreme of the toe toward the heel to a central boundary defined by a vertical cut-plane positioned perpendicularly to the length line of the clubhead.

Moreover, an object is to have a toe weight means of a first predetermined density comprising at least one toe weight of that portion of the head weight means in the toe section serving as inertial weight for the toe section.

Another object is to have first and second substantial percentages of the toe weight means as upper and lower concentrations of mass positioned respectively in predetermined fixed locations adjacent the top and bottom corners of the toe with each concentration between the striking face and back.

Too, an object is to have medium of a second predetermined density less dense than the first predetermined density of the toe weight means substantially separating the upper concentration from the lower concentration and generally separating the upper concentration from the central boundary.

Yet an additional object is to have the width of the toe weight means between the striking surface and the back assuming a first minimal value in the region toward the top and the central boundary, a first maximal value toward the top and the toe which is greater than than the first minimal value, a second minimal value between the upper and lower concentrations toward the toe which is less than the first maximal value, and a second maximal value toward the sole and toe which is greater than the second minimal value.

Still another object is to have a clubhead whereby the toe weight means has a density of at least 11.5 grams per cubic centimeter.

Moreover, another object is to have the first and second substantial percentages of the toe weight means as the upper and lower concentrations of mass whereby (i) the far extent toward the toe of the upper concentration and the far extent toward the toe of the lower concentration are each positioned within one-fourth the length of the clubhead from the extreme of the toe; (ii) the upper extent of the upper concentration toward the top and the lower extent of the lower concentration toward the sole are positioned within one-fourth the height of an clubhead from the extreme of the top and an extreme of the sole of the clubhead, respectively; (iii) the central extent of the upper concentration toward the central boundary is less than a half-length of the clubhead from the extreme of the toe; and (iv) the lower extent of the upper concentration toward the sole is less than a half-height of the clubhead from the extreme of the top of the clubhead.

Another object is to have a clubhead whereby the upper concentration of mass of the toe weight means has a length that is between one-twentieth to one-third the full length of the clubhead; a width that is between one-twentieth to nine-tenths the width of the clubhead; and a height that is between one-twentieth to one-third the height of the clubhead.

An additional object is to have a clubhead whereby the mass of the upper concentration of the toe weight means is less than half the total mass of the the toe weight means to control the vertical location of the center of mass of the clubhead.

Too, an object is to have a clubhead whereby the density of the upper concentration of the toe weight means is less than the density of the remainder of the toe weight means to control the vertical location of the center of mass of the clubhead.

Yet an additional object is a clubhead whereby both the length and the width of the upper concentration of the toe weight means are greater than the height of the upper concentration of the toe weight means.

Yet another object is a clubhead whereby the ratio of masses between the toe weight means and the complete mass of the toe section is at least 0.10; and whereby the the ratio of densities between the first predetermined density of the toe weight means and the second predetermined density of the medium in the toe section is at least 1.20. An additional object is to have this ratio of masses be at least 0.50; and this ratio of densities be at least 4.0.

Moreover, another object is to have a clubhead whereby the first minimal value of the width of the toe weight means between the striking surface and the back in the region toward the top and the central boundary is zero.

Another object is to have a clubhead whereby the first maximal value of the width of the toe weight means toward the top and the toe is less than the second maximal value of the width of the toe weight means toward the sole and the toe.

Too, an object is to have a clubhead whereby the polar moments of inertia of the clubhead are enhanced to reduce twisting and loft changes when a golf ball is struck.

Other objects and advantages of the current invention are to provide a golf clubhead that is not necessarily heavier, longer, broader, or higher than ordinary; yields a good solid feel when a ball is struck; is aesthetically appealing to golfers; and is econonomically attractive to both manufacturer and golfer.

Still more objects and advantages of my invention will become apparent from the drawings and ensuing description of it.

Figure 1:
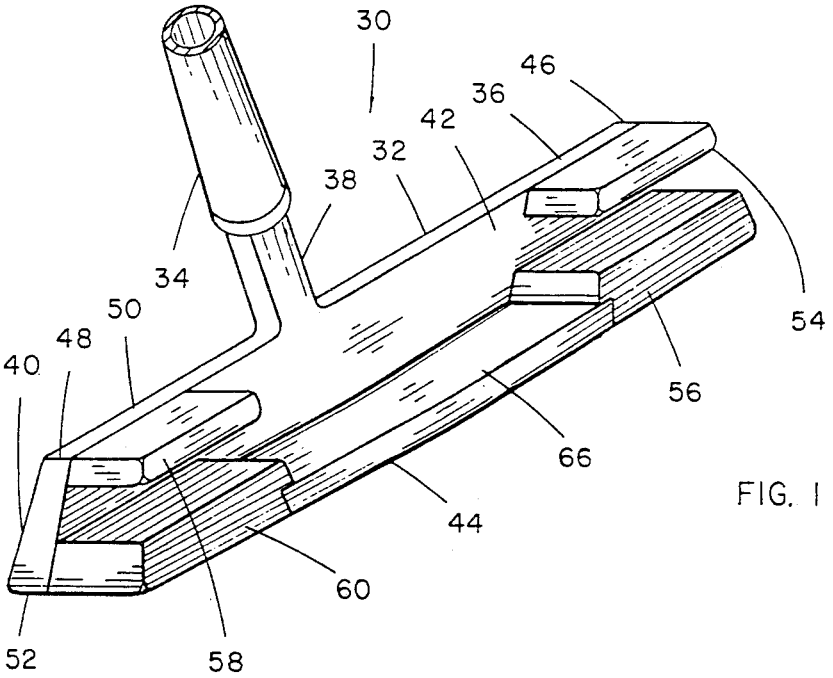
FIG. 1 is a perspective view of the clubhead of the present invention.

NUMERIC CODE 1-29—FIGURES
30-99—PARTS OF A PREFERRED EMBODIMENT
100-199—POINTS
200-299—AXES, LINES, SURFACES, AND ANGLES
300-399—DIMENSIONS

PARTS OF A PREFERRED EMBODIMENT 30 golf club putter
32 head
34 shaft
36 body
38 hosel
40 ball striking surface toward the front of head 32
42 rear surface
44 back
46 toe
48 heel
50 top
52 sole or bottom
54 upper toe weight
55*a* backside
55*b* outside
56 lower toe weight
58 upper heel weight
60 lower heel weight
62 male union for weight
64 female union for weight
66 extended sole
68 toe section
70 heel section

POINTS 100 geometric center of ball striking surface 40
104 center of mass of head 32
106 center of mass of upper toe weight 54
108 center of mass of lower toe weight 56

AXES, LINES, SURFACES, AND ANGLES 200 horizontal ground surface
204 horizontal loft or z-axis through geometric center 100 parallel to length line 300
206 vertical twist or y-axis through geometric center 100
208 horizontal x-axis through geometric center 100 perpendicular to horizontal loft axis 204 and vertical twist axis 206
212*a* partial circumference of a circle in a horizontal plane with vertical twist axis 206 as center and length 320*a* as radius to reference center of mass 106 of upper toe weight 54 212*b* partial circumference of a circle in a horizontal plane with vertical twist axis 206 as center and length 320*b* as radius to reference center of mass 108 of lower toe weight 56
214 angle of tilt of head 32 when a golf ball is miss-struck any vertical distance y off the preferred spot, here represented as geometric center 100
216 angle of twist of head 32 when a golf ball is miss-struck any horizontal distance x off the preferred spot, here represented as geometric center 100

DIMENSIONS

As a reminder, each of the following definitions assume that head 32 is soled on ground surface 200 in its normal position for addressing the ball.

300 horizontal length of head 32 between vertical projections of imaginary parallel planes that are perpendicular to the length line and placed at extremes of toe 46 and heel 48, respectively
302 half-length or half the length 300 of head 32
303 quarter-length or one-fourth the length 300 of head 32
304 vertical height of head 32 between horizontal projections of imaginary parallel planes placed at extremes of top 50, excluding hosel 38, and sole 52 on ground surface 200, respectively
306 half-height or half the height 304 of head 32
307 quarter-height or one-fourth the height 304 of head 32
308 horizontal width of head 32 between vertical projections of imaginary parallel planes from extreme toward ball striking surface 40 and extreme toward back 44 on a line perpendicular to 300
310*a* length of upper toe weight 54
310*b* width of upper toe weight 54
310*c* height of upper toe weight 54
312*a* length of lower toe weight 56
312*b* width of lower toe weight 56
312*c* height of lower toe weight 56
320*a* direct length from vertical twist or y-axis 206 to a vertical projection of center of mass 106 of upper toe weight 54

320*b* direct length from vertical twist of y-axis 206 to a vertical projection of center of mass 108 of lower toe weight 56

DETAILED DESCRIPTION OF A PREFERRED EMBODIMENT

In FIG. 1 number 30 refers to a golf club putter of the current invention. It has a head 32 to which a separate shaft 34 is fastened to body 36 via hosel 38 with adhesive. On head 32 there is also ball striking surface 40 toward the front which may be seen more directly in FIG. 8. Behind ball striking surface 40 are rear surface 42 and back 44. Head 32 also has a toe 46, a heel 48, a top 50, and a bottom or sole 52. In this embodiment ball striking surface 40 is positioned at the extreme front of head 32. In equally acceptable embodiments, other components, hosel 38 for example, may be positioned at the extreme front of head 32.

The objects of the current invention center around the weight distribution at the corners of head 32. In this regard there are upper and lower toe weights 54 and 56, respectively, and upper and lower heel weights 58 and 60, respectively. As seen in FIGS. 2–9, each of the weights has a male union 62 with which it adhesively joins a female union 64 on body 36. Thus, each weight is attached on rear surface 42 to tightly bind it to head 32. Lower toe weight 56 and lower heel weight 60 also have grooves in which they are braced by and adhesively bonded to extended sole 66. As an alternative to unions 62 and 64, any of the weights 54, 56, 58, and 60 might be bound to body 36 by other means such as soldering, welding, or pins. Thus the exact means by which any head weight is tightly bound to head 32 may be an open aspect of the current invention.

Figure 8:
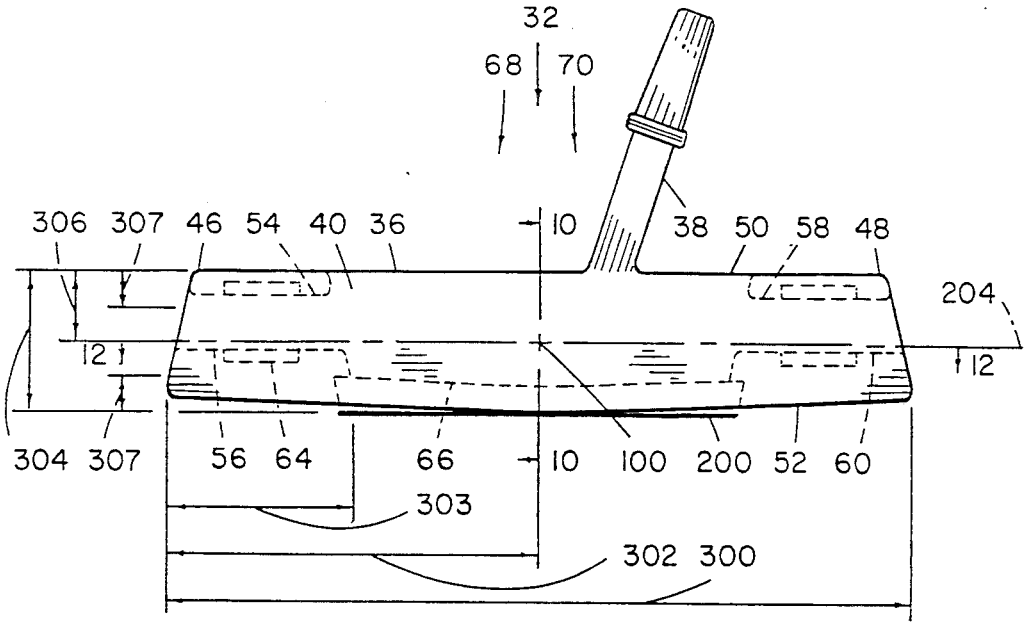
FIG. 8 is a front elevation view of the clubhead of FIG. 1.

Upper toe weight 54, lower toe weight 56, upper heel weight 58, and lower heel weight 60 are each head weights since they are positioned on head 32, and they may be separated from each other as shown, or they may be interconnected in any combination to form fewer than four head weights. Conversely, there may be more than four head weights. For example, extended sole 66 has multiple purposes, one of which is inertial in nature. Functionally, it serves as a means to level and rest head 32 in preparation for a stroke. Structurally it also serves as a means to brace ball striking surface 40 and lower weights 56 and 60. Inertially, it can also be viewed as extensions of lower weights 56 and 60 contributing with particular significance to the moment of inertia across horizontal loft axis 204 as shown in FIG. 8. Hence, extended sole 66, may viewed in part as a head weight.

As depicted body 36 is a casting of beryllium-copper and includes all material from ball striking surface 40 toward the front to back 44 except for that material in shaft 34; weights 54, 56, 58, and 60; and the adhesive. Similarly, weights 54, 56, 58, and 60 are cast separately of beryllium-copper before being bound to body 36. However, other materials such as brass or steel would serve as well. As an alternative disclosed in the grandparent, body 36 and weights 54, 56, 58, and 60 might instead be a single casting. As still another alternative disclosed in the parent, body 36 might be a casting of a lower density material such as aluminum and weights 54, 56, 58, and 60 might be castings of a variety of moderate or higher density materials such as beryllium-copper, lead, or tungsten. While the method of manufacture has emphasized casting, other methods such as forging, milling, or molding would also serve the purposes of the invention. Possibilities for head 32 also include materials such as strong plastics and graphite.

Too a head weight such as 54, 56, 58, and 60 may be made up of more than one distinct material, and similarly a body such as 36 may also may be made up of more than one material. In these circumstances the actual density of the weight or body should be used.

As shown body 36 is basically a blade with its width defined by extreme of ball striking surface 40 toward the front and rear surface 42 toward the back 44. Body 36 also includes a hosel 38 and extended sole 66. However the particular configuration of body 36 is not critical to this invention. For example, the volume behind rear surface 42 to back 44 from extended sole 66 to top 50 might include a very low density filler material. Under these circumstances body 36 might be shaped into a mallet putter or traditional iron or wood.

Figure 2:
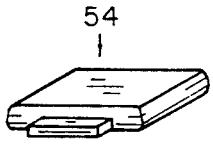
FIG. 2 is a perspective view of the upper toe weight of the clubhead of FIG. 1.
Figure 3:
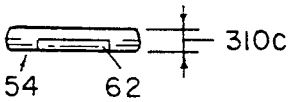
FIG. 3 is a front elevation view of the upper toe weight of FIG. 2.
Figure 4:
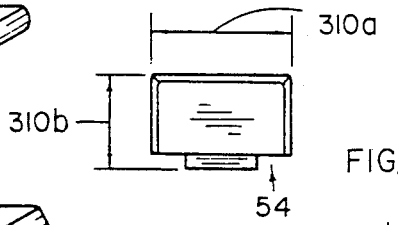
FIG. 4 is a top plan view of the upper toe weight of FIG. 2.
Figure 5:
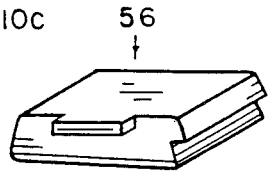
FIG. 5 is a perspective view of the lower toe weight of the clubhead of FIG. 1.
Figure 6:
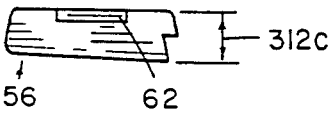
FIG. 6 is a front elevation view of lower toe weight of FIG. 5.
Figure 7:
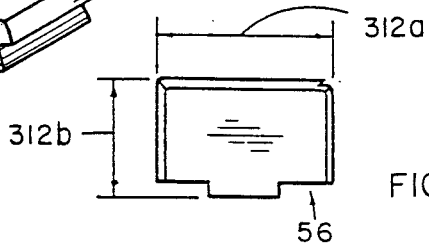
FIG. 7 is a top plan view of the lower toe weight of FIG. 5.

FIGS. 2–4 illustrate upper toe weight 54 and the detail of its male union 62. Length 310*a*, width 310*b* and height 310*c* of upper toe weight 54 are shown in FIGS. 3 and 4. FIGS. 5–7 illustrate lower toe weight 56 and the detail of its male union 62 together with the groove into which extended sole 66 fits. Length 312*a*, width 312*b*, and height 312*c* of lower toe weight 56 are shown in FIGS. 6 and 7. These length, width, and height dimensions are taken in parallel, respectively, with length 300, width 308, and height 304 of head 32 presented in FIGS. 8 and 9.

With reference to the front elevation view of FIG. 8, clubhead 32 is resting in its normal address position on ground surface 200. The drawing displays all hidden lines of components of head 32 behind ball striking surface 40. Shaft 34 is deleted in this and the following figures to illustrate more fully the details of hosel 38.

Horizontal length 300 is the heel-to-toe length for head 32. Half-length 302 from the extreme of toe 46 is half the length 300. Half-length 302 defines the position of vertical cut-plane 10—10 which is perpendicular to both ground surface 200 and length line 300. Cut-plane 10—10 divides head 32 into a toe section 68 and a heel section 70. Thus it is seen that the toe section 68 extends a half-length 302 of the clubhead 32 from the extreme of the toe 46 toward the heel 48 to a central boundary defined by the vertical cut-plane 10—10 positioned perpendicular to the length line 300 of the clubhead 32.

Figure 10:
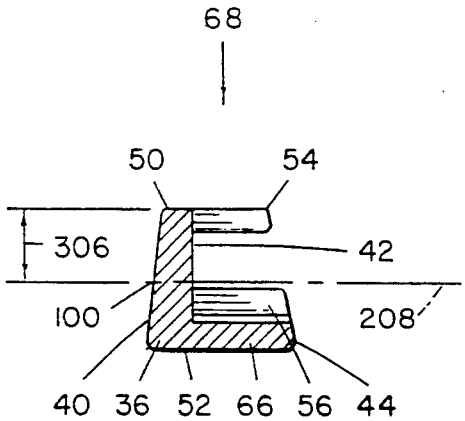
FIG. 10 is a cross-sectional side elevation view toward the toe end of the toe section of the clubhead of FIG. 8 as shown along the line 10—10.
Figure 11:
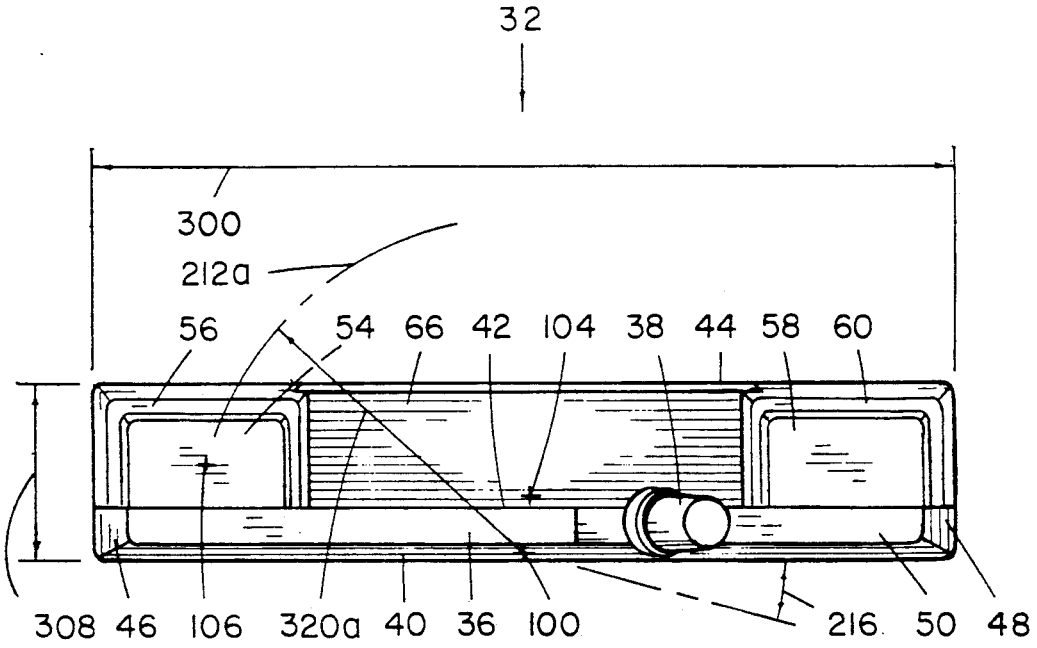
FIG. 11 is a top plan view of the clubhead of FIGS. 1, 8, and 9.

It will also be seen in FIG. 8 that head weights 54 and 56 are positioned in the toe section 68. These are also toe weights. Thus any head weight material positioned on the toe side of the central boundary of cut-plane 10—10 is a toe weight whether or not it is physically joined to a heel weight in the heel section 70. It follows from the discussion on head weights given above that toe weights 54 and 56 may be separated from each other as shown, or they may be interconnected to form one toe weight. There may also be more than two toe weights. For example, that portion of extended sole 66 in toe section 68 may be interpreted as a toe weight. It spans from the central boundary defined by cut-plane 10—10 to lower toe weight 56 and from rear surface 42 to back 44 as shown in FIGS. 8, 10, and 11.

Also in FIG. 8, half-length 302 sets one of the coordinates for geometric center 100 of ball striking surface 40. The other coordinate for geometric center 100 is half-height 306 as referenced from top 50. It is half the height 304 which is measured from the extreme of top 50 excluding hosel 38 to the extreme of sole 52 on ground surface 200.

In this embodiment the highest point of head 32 is seen to by anywhere on top 50 excluding the region where top 50 and hosel 38 intersect. This will not be true generally. On many iron-type clubheads the highest point on head 32 excluding hosel 38 will be near the toe end 46 of toe section 68. On many wood-type clubheads the highest point on head 32 excluding hosel 38 will be in the central region above and behind geometric center 100. However, Antonius in U.S. Pat. No. 4,828,265 dated May 9, 1989 disclosed a new wood-type clubhead having a deep, channel-shaped cavity formed in the central region of the top surface and extending rearward so that the highest point on head 32 excluding hosel 38 may be toward the toe 46. Conversely, Long in U.S. Des. Pat. No. 248,783 dated Aug. 1, 1978 illustrated a putter head 32 which also has its highest point excluding hosel 38 in the central region behind geometric center 100. Thus, some clubheads have an elevated top corner while others have a dropped top corner at the toe 46. Similarly, many clubheads have raised bottom corners at the toe 46 and heel 48 as shown in FIG. 8 to help prevent dragging on ground surface 200 as a ball is struck.

As well in FIG. 8, the top corner of toe 46 is indented toward the central boundary of cut-plane 10—10. On other putters, irons, and woods it is not unusual to have the bottom corner region of toe 46 indented instead. Thus the corner regions of toe 46 may be elevated or dropped and indented or not indented at the will of the designer. In qualitative terms the top corner region is a volume toward the toe 46 and top 50 in the toe section 68, but it need not necessarily be at the extreme of either toe 46 or top 50. Similarly, the bottom corner region is another volume toward the toe 46 and the sole or bottom 52 in the toe section 68, but it need not necessarily be at the extreme of either toe 46 or bottom 52.

Half-height 306 also defines the position for horizontal cut-plane 12—12 placed perpendicular to height line 304 and parallel with ground surface 200. As well horizontal loft axis 204 passes through geometric center 100. Axis 204 is shown as an extension of cut-plane 12—12, and it is parallel with length line 300.

Figure 9:
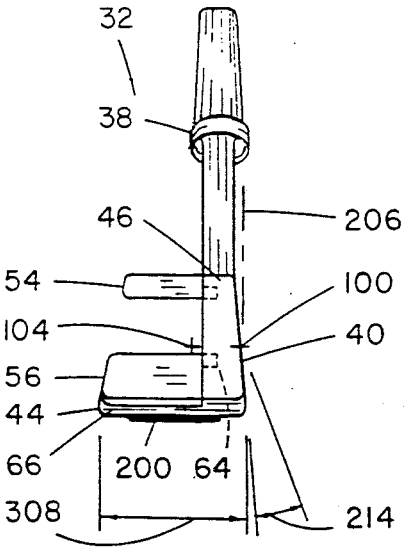
FIG. 9 is a side elevation view of the toe end of the clubhead of FIGS. 1 and 8.

FIG. 9 emphasizes the separation of toe weights 54 and 56 at the toe 46 of head 32. This perspective also provides a view of the horizontal width 308 of head 32 between vertical projections of imaginary planes from the extreme toward the front of ball striking surface 40 to the extreme toward back 44 with head 32 in its normal address position on ground surface 200. As seen in FIGS. 8 and 9, dimensions 300, 304, and 308 form a mutually perpendicular set.

Also shown in FIG. 9 are the geometric center 100 of ball striking surface 40 and the center of mass 104 of head 32. Vertical twist axis 206 through geometric center 100 extends upward. Center of mass 104 is in a desirable location at about the same height as geometric center 100. Center of mass 104 may be adjusted in a variety of ways including a change in the total height 304 of head 32, a change in either one or both vertical positions of weights 54 and 56, a redistribution of mass between weights 54 and 56, and a redistribution of density between weights 54 and 56. Finally, the angle of loft variation 214 in FIG. 9 will be used in the explanation of the operation of the invention.

The cross-sectional side view of FIG. 10 illustrates the toe section 68 of head 32 from a central perspective opposite that of the side elevation view of FIG. 9. Once again, the separation of upper toe weight 54 and lower toe weight 56 is manifest. Ball striking surface 40 is shown at its full height from the extreme of top 50 to the extreme of bottom 52 in the region of geometric center 100. The blade-type nature of body 36 between ball striking surface 40 and rear surface 42 is also manifest as is the relationship of extended sole 66 in body 36. Axis 208 through geometric center 100 is positioned a half-height 306 from the extreme of top 50. It intersects both vertical twist axis 206 and horizontal loft axis 204 at geometric center 100, and it is also perpendicular to both.

The top plan view of FIG. 11 illustrates details of head 32 as would be seen by a right-handed golfer about to make a stroke. Notably, the size of each of the upper weights 54 and 58 is seen to be less that of their lower counterparts 56 and 60, respectively. As suggested earlier, the distribution of mass between upper and lower weights may be used to raise or lower center of mass 104 of head 32. In FIG. 11, center of mass 104 is positioned slightly to the right of geometric center 100 due to the small contribution of hosel 38 in the heel section 70. Of course, the position toward either the toe 46 or heel 48 of center of mass 104 may be adjusted generally through the distribution of mass between toe section 68 and heel section 70 and specifically through the distribution of mass between toe weights 54 and 56 and heel weights 58 and 60. Too, if hosel 38 were changed in position, height, or mass, or eliminated altogether, this could lead to an even more dominant role for the weights in center of mass and inertial considerations.

Lastly in FIG. 11, there is an additional view of key dimensions and relationships. These include horizontal length 300 from the extreme of toe 46 to the extreme of heel 48 as well as horizontal width 308 from the extreme at the front of head 32 at ball striking surface 40 to the extreme at back 44. Length or radius **320*a* is the direct length from vertical twist axis 206 to a vertical projection of the center of mass 106 of upper toe weight 54. While vertical twist axis 206 is not shown in FIG. 11, it is perpendicular to the plane of the page through geometric center 100. Partial circumference 212*a* in a horizontal plane with vertical twist axis 206 as center and length 320*a* as radius references center of mass 106 of upper toe weight 54. It will useful in the discussion of the scope of the invention. Too, the angle of twist 216** will be used in the explanation of the operation of the invention.

Figure 12:
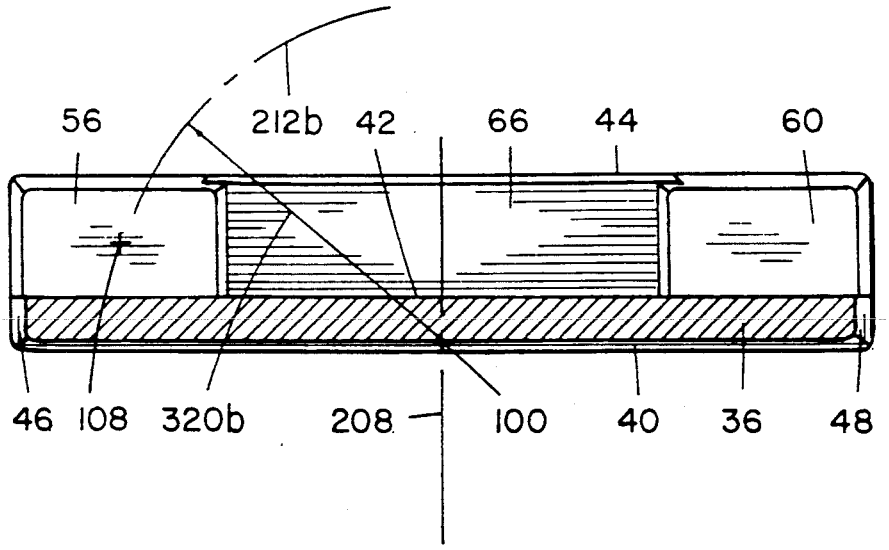
FIG. 12 is a top cross-sectional view of the clubhead of FIG. 8 as shown along line 12—12.

The top cross-sectional view in FIG. 12 illustrates the lower parts of the toe and heel sections as delineated respectively by x-axis 208 through geometric center 100. Once again, the blade-type body between ball striking surface 40 and rear surface 42 is manifest. Too, extended sole 66 runs from rear surface 42 to back 44 and from lower toe weight 56 to lower heel weight 60. Length or radius **320*b* is the direct length from vertical twist axis 206 to a vertical projection of the center of mass 108 of lower toe weight 56. Once again, while vertical twist axis 206 is not shown in FIG. 12, it is perpendicular to the plane of the page through geometric center 100. Partial circumference 212*b* in a horizontal plane with vertical twist axis 206 as center and length 320*b* as radius references center of mass 108 of lower toe weight 56**. It will also be used in the discussion of the scope of the invention.

The data in TABLE I will further assist in reviewing and understanding the invention. Here head 32 has a length 300 of 4.96 inches, a width 308 of 1.00 inch, and a height 304 of 0.90 inches. When head 32 is made entirely of beryllium-copper alloy, it has a total mass of 288 grams. When it has a body 36 of aluminum at a density of 2.70 g/cm$^3$ and weights 54, 56, 58, and 60 of tungsten alloy at a density of 17.0 g/cm$^3$, it has a total mass of 312 grams. Hence head 32 need not be heavier, longer, broader, or higher than ordinary.

Clubhead 32 may be viewed as comprising a body 36 and a head weight means including at least one head weight serving as inertial weight for the clubhead 32. Weights 54, 56, 58, and 60 have previously been interpreted as head weights.

TABLE I

Density, masses, dimensions, and critical ratios for a preferred embodiment similar to that in FIGS. 1-12.

| | |
|---|---|
| Density of beryllium-copper in body 36 and in weights 54, 56, 58, and 60 | 8.47 g/cm$^3$ |
| Mass of head 32 with hosel 38 | 288 g |
| Mass of body 36 with hosel 38 | 199 g |
| Mass of hosel 38 | 17.8 g |
| Mass of body 36 in toe section 68 | 90.6 g |
| Mass of upper toe weight 54 | 10.5 g |
| Mass of lower toe weight 56 | 34.1 g |
| Complete mass of toe section 68 | 135 g |
| Horizontal length 300 of head 32 | 4.96 in |
| Half-length of head 302 of head 32 | 2.48 in |
| Horizontal width 308 of head 32 | 1.00 in |
| Vertical height 304 of head 32 | 0.90 in |
| Half-height 306 of head of head 32 | 0.45 in |
| Horizontal length 310a of upper toe weight 54 | 0.97 in |
| Horizontal width 310b of upper toe weight 54 | 0.63 in |
| Vertical height 310c of upper toe weight 54 | 0.15 in |
| Horizontal length 312a of lower toe weight 56 | 1.23 in |
| Horizontal width 312b of lower toe weight 56 | 0.79 in |
| Vertical height 312c of lower toe weight 56 | 0.35 in |

Upper toe weight 54 and lower toe weight 56 may be viewed as a toe weight means of a first predetermined density comprising at least one toe weight of that portion of the head weight means in the toe section 68 serving as inertial weight for the toe section 68. Toe weights 54 and 56 may be regarded to be first and second substantial percentages of the toe weight means as upper and lower concentrations of mass positioned respectively in predetermined fixed locations adjacent the top and bottom corners of the toe 46 with each concentration between the striking face 40 and back 44.

In FIGS. 1, 9, and 10 particularly, it is seen that a medium, in this case air, of a second predetermined density less dense than the first predetermined density of the toe weight means substantially separates the upper concentration as upper toe weight 54 from the lower concentration as lower toe weight 56 and generally separates the upper concentration from the central boundary defined by cut-plane 10—10 and from any other portion of the toe weight means. As suggested earlier, a medium other than air may be used in the separations. Possibilities include a variety of lower density materials including plastic, graphite, and aluminum. When such materials are used for separation, they might perform duty, in part or full, as body 36.

While a beryllium-copper toe weight means has a density of about 8.5 g/cm$^3$, the density of the separating medium, air, is only about 0.0012 g/cm$^3$. Hence, the ratio of densities between the first predetermined density of the toe weight means and the second predetermined density of the separating medium in the toe section is of the order of 7,000. However, with a toe weight means of beryllium-copper and a separating medium of aluminum, the same density ratio decreases to 3.1. It is preferred to have a ratio of densities between the first predetermined density of the toe weight means and the second predetermined density of the separating medium of at least 1.20, and even more desirable that this ratio be at least 4.0.

Of course, when toe weights 54 and 56 are made of tungsten alloy at a density of 17.0 g/cm$^3$, the toe weight means has a density of at least 11.5 g/cm$^3$.

Another object was to have a clubhead whereby the density of the upper concentration of the toe weight means is less than the density of the remainder of the toe weight means to control the vertical location of the center of mass of the clubhead. This object may be met, for example, keeping upper toe weight 54 beryllium-copper and changing lower toe weight 56 to a higher density material such as lead, tungsten, or gold. Depending on its magnitude, such an adjustment of densities could make head 32 too heavy so that body 36 may also be made of a lower density material such as steel, titanium, or aluminum. While this object represents a preferred condition, it is not absolutely necessary in the practice of the invention. Under some circumstances as illustrated in FIGS. 1-12 and TABLE I, the density of upper toe weight 54 may be same as that in lower toe weight 56, while in other circumstances upper toe weight 54 may have a higher density than lower toe weight 56.

From TABLE I, the ratio of masses between the toe weight means as upper toe weight 54 and lower toe weight 56 and the complete mass of the toe section 68 is 0.33. It is desirable that this ratio of masses between the toe weight means and the complete mass of the toe section 68 be at least 0.10 and even more desirable that it be at least 0.50. This latter condition may be achieved with a body 36 of aluminum and weights 54 and 56 of tungsten alloy, for example.

Also in TABLE I, the ratio of the mass of upper toe weight 54 to the total mass of upper toe weight 54 and lower toe weight 56 is 0.235. Therefore, the preferred condition is met whereby the mass of the upper concentration of the toe weight means is less than half the total mass of the toe weight means to control the vertical location of the center of mass 104 of head 32. Again, while this object represents a preferred condition, it is not absolutely necessary in the practice of the invention. Under some circumstances, for example, upper toe weight 54 might have a mass equal to that of lower toe weight 56. In other circumstances the mass of upper toe weight 54 might be greater than that of lower toe weight 56.

As seen qualitatively in FIGS. 1, 9, 10, and 11, the width of the toe weight means between the striking surface 40 and the back 44 assumes a first minimal value in the region adjacent the top 50 and the central boundary defined by cut-plane 10—10. It then assumes a first maximal value adjacent the top 50 and the toe 46 which is greater than the first minimal value. This first maximal value is due to the width **310*b* of upper toe weight 54. The width of the toe weight means next assumes a second minimal value between the upper and lower concentrations as upper and lower toe weights 54 and 56, respectively, toward the toe 46 which is less than the first maximal value. Finally, it assumes a second maximal value toward the sole 52 and the toe 46 which is greater than the second minimal value. This second maximal value is seen to be due to the width 312*b* of lower toe weight 56**.

In FIGS. 1, 8, and 11 the width **310*b* of upper toe weight 54 goes to zero in the region toward the top 50** and the central boundary defined by cut-plane 10—10. Hence, a preferred condition exists whereby the first minimal value of the width of the toe weight means is zero between the striking surface 40 and the back 44 in the region adjacent the top 50 and the central boundary defined by cut-plane 10—10. In FIGS. 9–11 and TABLE I the width 310*b* of upper toe weight 54 is less than the width 312*b* of lower toe weight 56. Accordingly, another preferred condition exists whereby the first maximal value of the width of the toe weight means adjacent the top 50 and the toe 46 is less than the second maximal value of the width of the toe weight means adjacent the sole 52 and the toe 46.

Previously, it was stated that the corner regions of toe 46 may be elevated or dropped and indented or not indented at the will of the designer. Too, upper toe weight 54 may be indented down from the top 50 and in away from the extreme of toe 46 toward the central boundary defined by cut-plane 10—10. Similarly, lower toe weight 56 may indented up from sole 52 and in and away from the extreme of toe 46 toward the central boundary defined by cut-plane 10—10. In this manner there may be indentations upon indentations. In a preferred state, however, these will be limited as follows.

In FIG. 8 upper and lower toe weights 54 and 56, respectively, may be viewed as first and second substantial percentages of the toe weight means as upper and lower concentrations of mass whereby (i) the far extent toward the toe 46 of the upper concentration and the far extent toward the toe 46 of the lower concentration are each positioned within one-fourth the length 300 of clubhead 32, or quarter-length 303, from the extreme of toe 46; (ii) the upper extent of the upper concentration toward the top 50 and the lower extent of the lower concentration toward the sole 52 are positioned within one-fourth the height 304 of the clubhead 32, or quarter-height 307, from an extreme of the top 50 and an extreme of the sole 52, respectively; (iii) the central extent of the upper concentration toward the central boundary defined by cut-plane 10—10 is less than half the length 300 of the clubhead 32, or half-length 302, from the extreme of the toe 46; and (iv) the lower extent of the upper concentration toward the sole 52 is less than half the height 304 of the clubhead 32, or half-height 306, from the extreme of the top 50 of the clubhead 32.

In TABLE I, both the length 310*a* of upper toe weight 54 and its width 310*b* are seen to be greater than its height 310*c* which matches a preferred condition of having both the length and width of the upper concentration of the toe weight means greater than its height. In a related concern, the ratio of length 310*a* of upper toe weight 54 to the length 300 of head 32 is 0.196; the ratio of width 310*b* of upper toe weight 54 to width 308 of head 32 is 0.630; and the ratio of height 310*c* of upper toe weight 54 to the height 304 of head 32 is 0.167. Thus the upper concentration of mass of the toe weight means as upper toe weight 54 has a length 310*a* that is between one-twentieth to one-third the full length 300 of clubhead 32; a width 310*b* that is between one-twentieth to nine-tenths the width 308 of clubhead 32; and a height 310*c* that is between one-twentieth to one-third the height 304 of the clubhead 32.

The masses and dimensions for components such as upper toe weight 54 and lower toe weight 56 in TABLE I, are directly discernible from FIGS. 1–12 since these components are separable, discrete entities. However, if, for example, body 36 and weights 54, 56, 58, and 60 were a unitary casting, then the determination of masses and dimensions would become slightly more difficult. Under these circumstances, the criteria of reasonableness and fairness should come into play. For example, the widths of the weights could be taken reasonably and fairly as extending from rear surface 42 to back 44. This would shorten the dimensions 310*b* and 312*b* for upper toe weight 54 and lower toe weight 56, respectively, in TABLE I by a tenth of an inch with negligible changes in mass due to the small initial contributions of male unions 62.

OPERATION OF THE INVENTION

Computation using the algorithm Inertia on a beryllium-copper clubhead 32 similar to that in FIGS. 1–12 and TABLE I gave a moment about vertical twist axis 206 of 4300 g-cm$^2$ and a moment about horizontal loft axis 204 of 710 g-cm$^2$.

With reference to FIG. 9, when a golf ball is miss-struck any vertical length off the preferred spot, here represented as the geometric center 100 of the ball striking surface 40, the angle of tilt 214 of head 32 will tend to be diminished as a result of an enhanced moment of inertia along horizontal loft axis 204 as shown in FIG. 8. With reference to FIG. 11, when a golf ball is miss-struck any horizontal length off the geometric center 100, the angle of twist 216 of head 32 will also tend to be diminished, this time as a result of an enhanced moment of inertia along vertical twist axis 206 as shown in FIG. 9. Of course, when a ball is simultaneously miss-struck a vertical length and a horizontal length of the preferred spot, then angle of tilt 214 and the angle of twist 216 will both tend to be diminished for the reasons given above, respectively.

Too, these desirable results may be enhanced even more. For example, when head 32 is kept dimensionally similar, but has a body 36 of aluminum at 2.70 g/cm$^3$ and tungsten alloy weights at 17.0 g/cm$^3$ as previously discussed, then the moment about twist axis 206 increases to about 5700 g-cm$^2$ while that about loft axis 204 increases to about 850 g-cm$^2$. Accompanying these improvements, center of mass 104 of head 32 also moves downward toward ground surface 200 by about 0.12 inches and rearward toward back 44 by about 0.17 inches. The increase in mass by about eight percent from 288 to 312 grams accounts for part of the improvement, but the major effect is the density increase or compression of mass onto the corners of clubhead 32.

As illustrated, head 32 is quite compact, particularly in its height 304 and width 308. Accordingly, both moments might be further enhanced, particularly over a cavity-back or hollow-back clubhead, with the additional measures discussed in the parent and grandparent.

SCOPE, RAMIFICATIONS, CONCLUSION

Thus, it may be recognized that the corner-back clubhead 32 of the present invention is a general model for golf clubheads whereby the polar moments of inertia of the clubhead are enhanced to resist twisting and loft changes when a golf ball is struck. As the invention is primarily concerned with relative mass and density distributions as well as certain lengths, a suitable clubhead can be made for any person of any size and age.

While my above description contains many specificities, these should not be construed as limitations of the scope of the invention, but rather as exemplication of one preferred embodiment thereof. Many other variations are possible.

Also, it will be readily seen by persons familiar with the art and science of designing golf clubs that the principles, practices, variations, modifications, and equivalents of the preferred embodiment of this invention may be readily applied to all classes of clubs including as well other monofacial putters, bifacial putters, woods, irons, and utility clubs as included within the spirit and scope of the appended claims.

While parameters such as hosel position, loft, total weight, shaft length, and the grooves in the clubface may change from clubhead to clubhead, the appended claims do not relate to these parameters. Instead, they relate to the distribution of mass and density and to certain design ratios, primarily in the toe section of the clubhead. The distribution of mass and density and the design ratios are common to all corner-back clubheads.

Accordingly, the position of hosel 38 is not critical to this invention. Head 32 may be center-shafted as illustrated in FIGS. 1, 8, 9, and 11; or it may be heel-shafted; or less likely, in the case of putters, it may even be toe-shafted. If a part or all of hosel 38 resides in the toe section 68, then its proportional contribution to the mass should be included in that section. In fact hosel 38 is optional as other known means such as a simple hole in head 32 would do to attach a shaft 34 in some circumstances. One advantage of reducing hosel 38 in size and mass, or deleting it altogether, is that the large moment of inertia about the swing axis may be enhanced with the lower center of mass of the clubhead 32. Furthermore, as hosel 38 is diminished either or both upper toe weight 54 and upper heel weight 58 might be increased in size and mass to retain the moment of inertia about horizontal loft axis 204 and vertical twist axis 206.

It may be found instructive to take this a step further and consider how the design of golf club putter 30 might be approximately modified so as to make it into an iron or wood. As seen especially in FIG. 8, ball striking surface 40 is trapezoidal in shape with the length across top 50 being slightly less than that across sole 52. For an iron or wood, these lengths might be reversed so that the length across top 50 would be greater than that across sole 52. As previously discussed, this amounts to reversing the identation of head 32.

For both the iron and wood, hosel 38, if it is included, might be strengthened and moved to the extreme region of heel 48. In the case of the iron, hosel 38 would most likely be positioned at the front in the region of ball striking surface 40. For the wood, hosel 38 might be positioned in the region between the ball striking surface 40 and the back 44. Other changes would be similar in kind for both the iron and wood as follows.

As is well known in the trade, the total mass of gold clubs is relatively constant throughout a set including putter, irons and woods, if anything, usually decreasing slightly through this progression. Accordingly as the length and mass of the shafts increase in progressing from putter, irons, and woods, the mass of the clubheads may decrease proportionally.

Thus, the iron or wood head may be made with less mass by an amount approximately in proportion to the increase in mass of the shaft for the iron or wood over that for the golf putter 30. Also, since the clubhead is now heel-shafted, some mass might be re-arranged between the toe weights 54 and 56 and the heel weights 58 and 60 so that there was something approximating a 60–40 percent split between the masses of the toe section 68 and the heel section 70, respectively. This combined with fact that the lower weights 56 and 60 may be heavier than the respective upper weights 54 and 58 indicates that upper heel weight 58 might be made the lightest and lower toe weight 56 might be made the heaviest of the four weights. Of course, upper and lower heel weights 58 and 60 might be eliminated altogether and the invention would still retain its essential spirit as set forth in the appended claims. Also, the loft of clubhead 32 could be increased and appropriate grooves added to ball striking surface 40.

The possibility of eliminating upper and lower heel weights 58 and 60, respectively, raises the question of the minimum of requirements of the corner-back clubhead. As implied throughout the discussion, the answer is a corner-back toe section 68 with weights 54 and 56 adjacent the top and bottom corners of the toe 46 as previously specified and interpreted for putter clubhead 32.

Too, the shape and size of the toe weights 54 and 56 might change somewhat in progressing from putter to wood to iron. However, the relative positioning of a substantial portion of their masses toward their respective corners of the clubhead would remain constant. Regarding changes in size, weights 54 and 56 might be substantially smaller and less massive for clubheads 32 of the iron and wood type because of the greater need for structural strength, and thereby mass, in the body 36 and hosel 38. Also in some clubheads 32 of the iron type, the respective widths **310*b* and 312*b* of upper toe weight 54 and lower toe weight 56 might be substantially reduced because rearward projections from their traditionally thin blade-type bodies 36 might be unwanted. For this case the weights 54 and 56 might be entered into recesses in the body 36 parallel with the length parameter 300 in the top and bottom corner regions of the toe 46**, respectively.

Finally, for particularly the iron and perhaps the wood, it may be desirable to tilt the horizontal loft 204 and vertical twist 206 axis system upward slightly at the toe 46 to make horizontal loft axis 204 parallel with the larger swing axis discussed earlier.

None of these changes, however, would necessarily alter the basic distributions of mass and density for the corner-back toe section 68 of a clubhead 32. Therefore, these and any other modifications could be carried out in a relatively straightforward fashion.

In the grandparent it was stated that traditionally-shaped wood and iron clubs were beyond the scope of that invention. This included woods made of persimmon, maple, or laminated materials as constructed on a lathe. It also included modern hollow-back irons and woods made by body casting. The reason for this exclusion was that the parent was about the corner-back configuration itself. However, the present invention is about a corner-back clubhead. Hence, while the weights must occupy positions toward the corners as specified in the appended claims, the shape of the heads 32 may vary widely. Therefore, as indicated earlier, a head 32 may be of traditional shape, in a corner-back configuration, or of some other geometry.

Also in the grandparent certain extensions of upper toe weight 54 and lower toe weight 56 were discussed. In one case, also desirable here, upper toe weight 54 and lower toe weight 56 were joined adjacent the back 44 leaving a substantial separation between them in the form of hole from the inside toward the central boundary defined by cut-plane 10—10 to the outside toward the extreme of the toe 46. As well, the two weights 54 and 56 might be joined along either or both the inside adjacent the central boundary defined by cut-plane 10—10 and the outside adjacent the extreme of the toe 46 provided a substantial separation remains. In an extreme case they might even be joined along the inside adjacent the central boundary defined by cut-plane 10—10, along the outside adjacent the extreme of toe 46, and along the backside adjacent back 44 provided there is a substantial separation in the form of a hollow between the weights 54 and 56.

Figure 13:
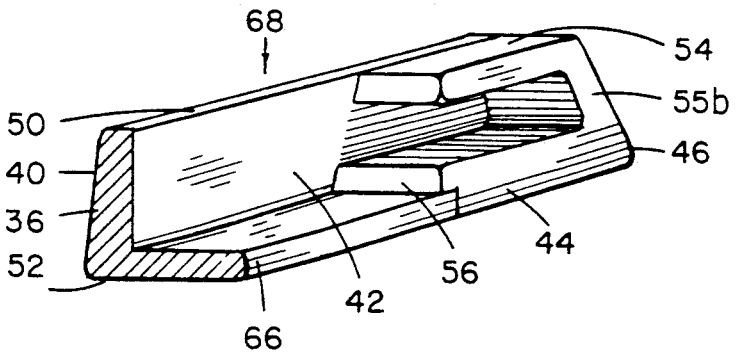
FIG. 13 is a perspective view toward the toe end of the toe section of FIG. 10 whereby the upper toe weight and the lower toe weight are now joined together along an outside of the upper toe weight adjacent the extreme of the toe.
Figure 14:
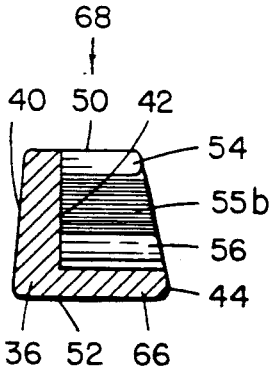
FIG. 14 is a cross-sectional side elevation view toward the toe end of the toe section of the clubhead of FIG. 13.
Figure 15:
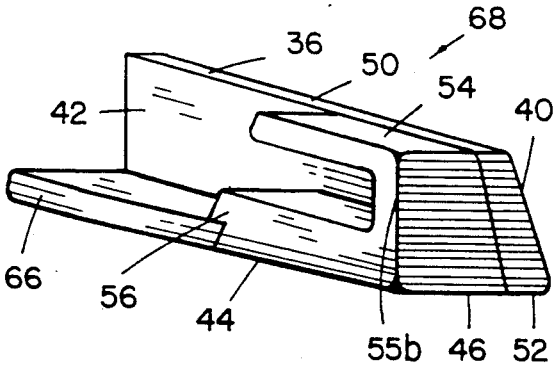
FIG. 15 is a perspective view from the toe end of the toe section of the clubhead of FIG. 13.
Figure 16:
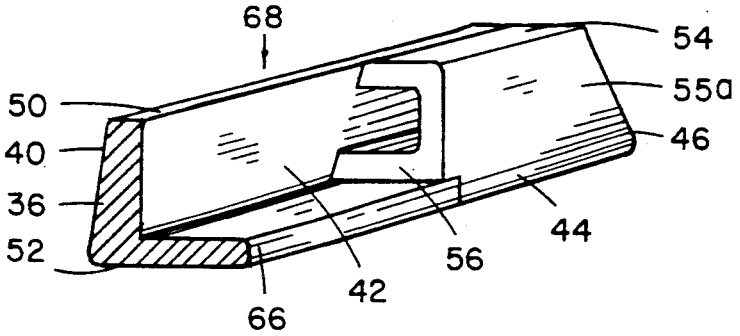
FIG. 16 is a perspective view toward the toe end of the toe section of FIG. 10 whereby the upper toe weight and the lower toe weight are now joined together along a backside of the upper toe weight adjacent the back.
Figure 17:
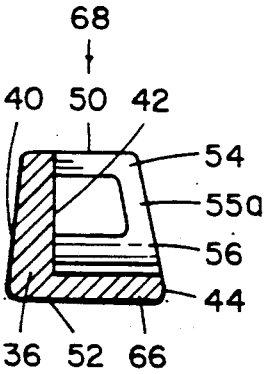
FIG. 17 is a cross-sectional side elevation view toward the toe end of the toe section of the clubhead of FIG. 16.
Figure 18:
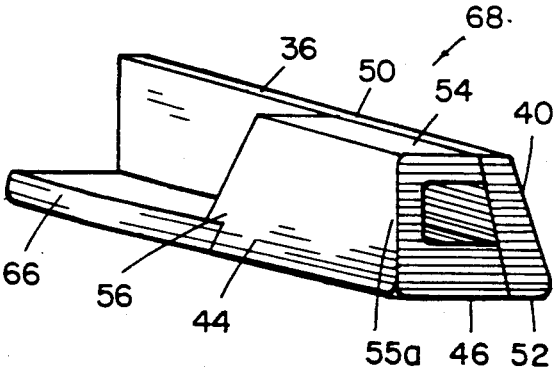
FIG. 18 is a perspective view from the toe end of the toe section of the clubhead of FIG. 16.
Figure 19:
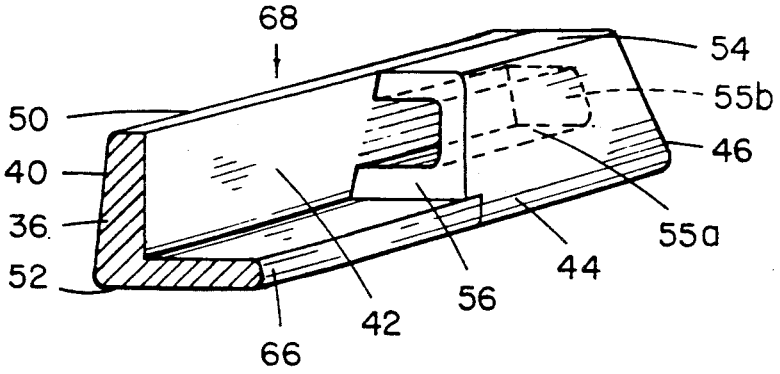
FIG. 19 is a perspective view toward the toe end of the toe section FIG. 10 whereby the upper toe weight and the lower toe weight are now joined together along an outside of the upper toe weight adjacent the extreme of the toe and along a backside of the upper toe weight adjacent the back.
Figure 20:
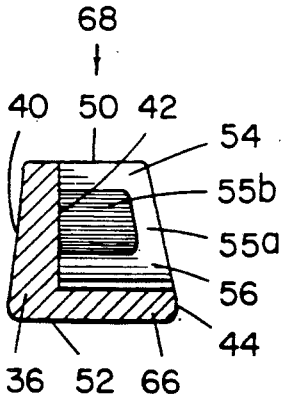
FIG. 20 is a cross-sectional side elevation view toward the toe end of the toe section of the clubhead of FIG. 19.
Figure 21:
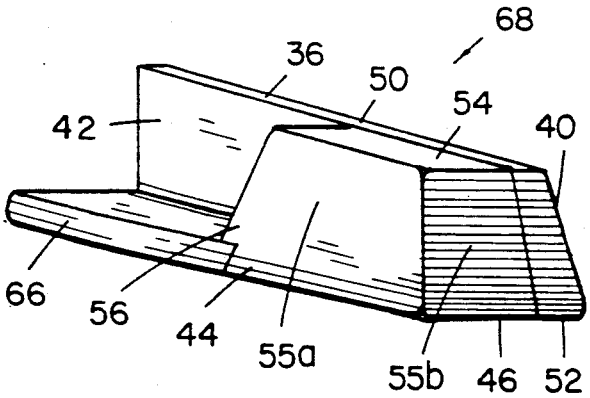
FIG. 21 is a perspective view toward the toe end of the toe section of the clubhead of FIG. 19.

Some of these possibilities are illustrated in FIGS. 13–21. Here FIGS. 13–15 present various perspectives of a toe section 68 whereby upper toe weight 54 and lower toe weight 56 are joined together along an outside 55*b* of the upper toe weight 54 adjacent the extreme of the toe 46. FIGS. 16–18 present various perspectives of a toe section 68 whereby upper toe weight 54 and lower toe weight 56 are joined together along a backside 55*a* of the upper toe weight 54 adjacent the back 44. FIGS. 19–21 present various perspectives of a toe section 68 whereby upper toe weight 54 and lower toe weight 56 are joined together along an outside 55*b* of upper toe weight 54 adjacent the extreme of the toe 46 and along a backside 55*a* of the upper toe weight 54 adjacent the back 44.

Another case, which was undesirable in the grandparent, but is desirable here, had to do with the possibility of extending upper toe weight 54 along partial circumference 212*a* to perhaps join upper heel weight 58 forming a half-washer in a horizontal plane behind ball striking surface 40. In a similar fashion lower toe weight 56 might be extended along partial circumference 212*b* toward heel 48 joining lower heel weight 60 in another half-washer in a horizontal plane behind ball striking surface 40. The reason such extensions were undesirable in the grandparent had to do with the thrust of that work toward defining the corner-back configuration. In contrast, the thrust of the present effort runs in the direction of a corner-back clubhead.

Similarly, head weights 54, 56, 58 and 60 could be joined to head 32 by means other than direct union with rear surface 42. As another acceptable possibility such a head weight could be separated entirely from rear surface 42 and attached in a similar position with a separate system of braces. As still another possibility, head weights 54, 56, 58, and 60 might be distributed so as to occupy similar positions on the inside of a hollow iron or wood clubhead 32. As yet another possibility, they might be distributed so as to occupy similar positions on the outside of a traditional wooden club.

Too, the width of extended sole 66 is not critical to this invention. It may be narrower, wider, or even deleted altogether. It has been suggested that extended sole 66, if it is present, might be interpreted as a head weight. Among other possibilities, this raises the problem of distinguishing between extended sole 66 and lower toe weight 56. While these two are clearly separate entities in FIGS. 1–12, they would be less so if head 32 were made of a single casting. Taking this a step further, extended sole 66 and lower toe weight 56 may be made virtually indistinguishable by eliminating the slight ridge in their union through smoothing. Under these circumstances, the presence of a concentration of mass toward the lower corner of toe 46, whether or not that concentration is smoothly joined to extended sole 66, indicates the presence of lower toe weight 56.

Such considerations raise a question as to the measurement of the length, width, and height parameters for weights 54 and 56. In FIGS. 1–12, their measurement is straightforward since toe weights 54 and 56 are discrete, separable entities. However, if head 32 were made of a single casting, then, for example, measurement of the width 310*b* of upper toe weight 54 and width 312*b* of lower toe weight 56 would be slightly less straightforward. However, a reasonable and fair way to proceed would involve taking these widths from rear surface to back 44. In this manner widths 310*b* and 312*b* would each be diminished by a tenth of an inch from the values shown in TABLE I. Thus, the criteria of reasonableness and fairness should prevail on questions of measurement.

The absolute data on masses and dimensions for head 32 as set forth in TABLE I are not critical to the invention. For a small child's clubhead they might be less. For a large adult's clubhead might be more. It has also been shown that there may be latitude in the portioning of mass between body 36 and head weights 54, 56, 58, and 60. However, some of the values set forth in TABLE I are of importance because they are within the ranges set forth in the appended claims.

As to theory in the parent and grandparent, the invention is not bound by the path of the development of the theory or the resultant theory itself beyond that necessary for the appended claims. Other starting points and other pathways, theoretical or purely empirical, could lead to a similar invention. In this case, the theory is regarded as an essentially separate entity that guided the definition of several empirical design ratios that are helpful in describing the invention. This empirical realm of ratios covers key masses, densities, and lengths.

In the parent and grandparent some of the possible alternate positions and shapes for the toe weight means were discussed. Because of the higher degree of complexity of this invention, there are essentially an infinite number of possible aternative shapes. Of primary importance in the present invention is the positioning of the toe weight means adjacent the top and bottom corners of the toe as delineated precisely in the appended claims.

Accordingly, the scope of the invention should not be determined by the embodiment illustrated, but by the appended claims and their legal equivalents.

The following material provides some alternative description of head 32 as depicted in FIGS. 1–12.

Upper toe weight 54 and lower toe weight 56 are positioned adjacent the top 50 and the toe 46 and adjacent the sole 52 and the toe 46, respectively. Accordingly we have first and second substantial percentages of the toe weight means as an upper concentration of mass and a lower concentration of mass positioned in predetermined fixed locations adjacent the top 50 and the toe 46 and adjacent the sole 52 and the toe 46, respectively, with each of these concentrations extending between the striking surface 40 and the back 44.

The upper concentration of mass as upper toe weight 54, from limits between the extreme of the toe 46 and the central boundary defined by cut-plane 10—10 in FIG. 8, is seen to exist in a compact form.

The medium, in this case air discussed earlier with reference to FIGS. 1,9, and 10 and which separates upper toe weight 54 from lower toe weight 56 and which separates upper toe weight 54 from the central boundary of the toe section 68 defined by cut-plane 10—10, may be thought of as a medium means. Accordingly, we have a medium means of a second predetermined density less dense than the first predetermined density of the toe weight means generally separating the upper concentration as upper toe weight 54 from the central boundary defined by cut-plane 10—10 in FIG. 8 and substantially separating the upper concentration as upper toe weight 54 from the lower concentration as lower toe weight 56 along an inside of the upper concentration adjacent the central boundary and along a bottomside of the upper concentration near the inside of upper toe weight 54 and toward the sole 52. In FIG. 8 the bottomside of upper toe weight 54 toward the sole 52 is seen to have limits between the inside of upper toe weight 54 adjacent the central boundary of cut-plane 10—10 and the outside of upper toe weight 54 adjacent the extreme of the toe 46.

Yet again, there is a medium means of a second predetermined density less dense than the first predetermined density of the toe weight means generally separating the upper concentration as upper toe weight 54 from the central boundary defined by cut-plane 10—10 and substantially separating the upper concentration as upper toe weight 54 from the lower concentration as lower toe weight 56 along an outside of the upper concentration adjacent the extreme of the toe 46 and along a bottomside of the upper concentration near the outside of upper toe weight 54 and toward the sole 52.

What is claimed is:

1. A golf clubhead comprising:

a. a body;

b. a head weight means comprising at least one head weight serving as inertial weight for said clubhead;

c. a toe and heel, a front and back, and a top and a sole with a ball striking surface toward said front;

d. a binding means to attach said head weight means to said clubhead;

e. a fastening means to affix a shaft between said heel and said toe;

f. a toe section of said clubhead extending a half-length of said clubhead from an extreme of said toe toward said heel to a central boundary defined by a vertical cut-plane positioned perpendicularly to the length line of said clubhead;

g. a toe weight means of a first predetermined density comprising at least one toe weight of the portion of said head weight means in said toe section serving as inertial weight for said toe section;

h. first and second substantial percentages of said toe weight means as an upper concentration of mass and a lower concentration of mass positioned in predetermined fixed locations adjacent said top and said toe and adjacent said sole and said toe, respectively, with each said concentration extending between said striking face and said back;

i. said upper concentration, from limits between the extreme of said toe and said central boundary, existing in a compact form;

j. a medium means of a second predetermined density less dense than said first predetermined density of said toe weight means generally separating said upper concentration from said central boundary and substantially separating said upper concentration from said lower concentration along an inside of said upper concentration adjacent said central boundary and along a bottomside of said upper concentration near said inside and toward said sole; whereby k. polar moments of inertia of said clubhead are enhanced to reduce twisting and loft changes when a golf ball is struck.

2. The golf clubhead of claim 1 whereby said toe weight means has a density of at least 11.5 grams per cubic centimeter.

3. The golf clubhead of claim 1 whereby;

a. the far extent toward said toe of said upper concentration and the far extent toward said toe of said lower concentration are each positioned within one-fourth the length of said clubhead from the extreme of said toe;

b. the upper extent of said upper concentration toward said top and the lower extent of said lower concentration toward said sole are each positioned within one-fourth the height of said clubhead from an extreme of said top and extreme of said sole of said clubhead, respectively;

c. the central extent of said upper concentration toward said central boundary is less than said half-length of said clubhead from said extreme of said toe; and d. the lower extent of said upper concentration toward said sole is less than a half-height of said clubhead from the extreme of said top of said clubhead.

4. The golf clubhead of claim 3 whereby said upper concentration of mass has a length that is between one-twentieth to one-third the full length of said clubhead; a width that is between one-twentieth to nine-tenths the full width of said clubhead; and a height that is between one-twentieth to one-third the height of said clubhead.

5. The golf clubhead of claim 4 whereby the mass of said upper concentration is less than half the total mass of said toe weight means to control the vertical location of the center of mass of said clubhead.

6. The golf clubhead of claim 4 whereby the density of said upper concentration is less than the density of the remainder of said toe weight means to control the vertical location of the center of mass of said clubhead.

7. The golf clubhead of claim 4 whereby said toe weight means has a density of at least 11.5 grams per cubic centimeter.

8. The golf clubhead of claim 4 whereby both said length and said width of said upper concentration are greater than said height of said upper concentration.

9. The golf clubhead of claim 4 whereby the ratio of masses between said toe weight means and the complete mass of said toe section is at least 0.10; and whereby the ratio of densities between said first predetermined average density of said toe weight means and said second predetermined average density of said medium means in said toe section is at least 1.20.

10. The golf clubhead of claim 9 whereby said ratio of masses is at least 0.50; and said ratio of densities is at least 4.0.

11. The golf clubhead of claim 1 whereby said upper concentration of mass and said lower concentration of mass are joined together along a backside of said upper concentration adjacent said back.

12. The golf clubhead of claim 11 whereby said upper concentration of mass and said lower concentration of mass are joined together along an outside of said upper concentration adjacent the extreme of said toe.

13. The golf clubhead of claim 1 whereby said upper concentration of mass and said lower concentration of mass are joined together along an outside of said upper concentration adjacent the extreme of said toe.

14. A golf clubhead comprising:

a. a body;

b. a head weight means comprising at least one head weight serving as inertial weight for said clubhead;

c. a toe and heel, a front and back, and a top and a sole with a ball striking surface toward said front;

d. a binding means to attach said head weight means to said clubhead;

e. a fastening means to affix a shaft between said heel and said toe;

f. a toe section of said clubhead extending a half-length of said clubhead from an extreme of said toe toward said heel to a central boundary defined by a vertical cut-plane positioned perpendicularly to the length line of said clubhead;

g. a toe weight means of a first predetermined density comprising at least one toe weight of the portion of said head weight means in said toe section serving as inertial weight for said toe section;

h. first and second substantial percentages of said toe weight means as an upper concentration of mass and a lower concentration of mass positioned in predetermined fixed locations adjacent said top and said toe and adjacent said sole and said toe, respectively, with each said concentration extending between said striking face and said back;

i. said upper concentration, from limits between the extreme of said toe and said central boundary, existing in a compact form;

j. a medium means of a second predetermined density less dense than said first predetermined density of said toe weight means generally separating said upper concentration from said central boundary and substantially separating said upper concentration from said lower concentration along an outside of said upper concentration adjacent the extreme of said toe and along a bottomside of said upper concentration near said outside and toward said sole; whereby k. polar moments of inertia of said clubhead are enhanced to reduce twisting and loft changes when a golf ball is struck.

15. The golf clubhead of claim 14 whereby said toe weight means has a density of at least 11.5 grams per cubic centimeter.

* * * * *